United States Patent [19]

Carandang

[11] Patent Number: 4,851,149

[45] Date of Patent: Jul. 25, 1989

[54] NON-TOXIC ACID CLEANER CORROSION INHIBITORS

[75] Inventor: Carmen M. Carandang, Oaks, Pa.

[73] Assignee: Henkel Corporation, Ambler, Pa.

[21] Appl. No.: 98,712

[22] Filed: Sep. 21, 1987

Related U.S. Application Data

[63] Continuation of Ser. No. 879,648, Jun. 27, 1986, abandoned.

[30] Foreign Application Priority Data

Nov. 13, 1985 [DE] Fed. Rep. of Germany ..... 3540246

[51] Int. Cl.[4] ..... C11D 7/08; C23F 11/04; C23F 11/14; C23F 11/18

[52] U.S. Cl. ..... 252/147; 134/3; 252/106; 252/136; 252/146; 252/148; 252/389.1; 252/390; 252/392; 252/394; 422/12; 422/16

[58] Field of Search ..... 134/3; 252/106, 136, 252/146, 147, 148, 389.1, 390, 392, 394; 422/12, 16

[56] References Cited

U.S. PATENT DOCUMENTS

| | | | |
|---|---|---|---|
| 2,708,184 | 5/1955 | Hager | 252/147 |
| 2,977,315 | 3/1961 | Scheib | 252/106 |
| 3,029,183 | 4/1962 | Winicov | 252/106 |
| 3,087,853 | 4/1963 | Hosmer | 252/106 |
| 3,136,755 | 6/1964 | Grosser | 252/106 |
| 3,161,598 | 12/1964 | Geld | 252/147 |
| 3,249,547 | 5/1966 | Fisher | 252/136 |
| 3,260,673 | 7/1966 | Fisher | 252/136 |
| 3,296,149 | 1/1967 | Cook | 252/389 |
| 3,349,037 | 10/1967 | Peterson | 252/146 |
| 3,505,184 | 4/1970 | Schaedler et al. | 204/55 |
| 3,539,520 | 11/1970 | Cantor | 252/106 |
| 3,686,129 | 8/1972 | Loucks | 252/147 |
| 3,687,855 | 8/1972 | Halpern | 252/106 |
| 3,728,267 | 4/1973 | Hirota | 252/142 |
| 3,728,449 | 4/1973 | Cantor | 424/150 |
| 3,773,465 | 11/1973 | Keeney | 252/147 |
| 3,816,322 | 6/1974 | Griffin | 252/147 |
| 3,898,326 | 8/1975 | Cantor | 424/80 |
| 3,911,107 | 10/1975 | Krezanoski | 424/78 |
| 4,017,407 | 4/1977 | Cantor | 252/106 |
| 4,088,597 | 5/1978 | Morlock | 252/106 |
| 4,094,967 | 6/1978 | Gilbert | 424/28 |
| 4,214,059 | 7/1980 | Hofer | 424/150 |
| 4,275,194 | 6/1981 | Kato | 424/150 |
| 4,444,756 | 4/1984 | Schlussler | 252/106 |
| 4,518,519 | 5/1985 | Lott | 252/148 |
| 4,576,818 | 3/1986 | Shetty | 424/150 |
| 4,595,517 | 6/1986 | Abadi | 252/82 |

FOREIGN PATENT DOCUMENTS

| | | |
|---|---|---|
| 49-35244 | 1/1974 | Japan . |
| 1052771 | 12/1966 | United Kingdom . |

OTHER PUBLICATIONS

Desai et al., *J. Inst. Chem. Calcutta,* 45, Part IV, 135–7, (1973).

Talati et al., *Vidya,* 12(2), 182–192, (1969).

Koshel et al., *Australas. Corros. Eng.,* 18(8), 17–19, (1974).

Talati et al., *Acta. Cienc. Indica.,* 2(3), 219–225, (1976).

*Chemical Abstracts,* Service Registry.

*Primary Examiner*—Dennis Albrecht

*Attorney, Agent, or Firm*—Ernie G. Szoke; Wayne C. Jaeschke; Norvell E. Wisdom, Jr.

[57] ABSTRACT

Acid cleaning/pickling compositions for metal surfaces containing (A) at least one protein-derived polymer, sugar-derived polymer, sorbitol, tannin, or vinyl-based polymer, (B) at least one iodine or iodine-affording compound; acids solutions prepared therefrom; and methods for their use.

14 Claims, No Drawings

NON-TOXIC ACID CLEANER CORROSION INHIBITORS

This application is a continuation of application Ser. No. 879,648, filed June 27, 1986 now abandoned.

BACKGROUND OF THE INVENTION

1. Field of the Invention

This invention relates to corrosion inhibitors for use in acidic cleaning and pickling compositions. More particularly, the invention relates to corrosion inhibitors for incorporation into acidic pickling solutions that are used to clean the surfaces of metals used in water wells and other units holding or delivering or otherwise coming into contact with, potable water.

2. Statement of the Related Art

Water wells containing potable water require periodic cleaning in order to remove scale from the well casings, well screens, pump bowls, etc. Typically, this scale is removed using an acid solution, generally a solution of hydrochloric acid. However, when such acid cleaning agents are used, several of the components forming the pumping mechanism are subject to attack by the acid, in particular, the well screen which is usually made of 304 stainless steel, the well casing which is usually made of mild steel, and especially the pump bowl which is usually cast iron. The hydrochloric acid is usually present in the cleaners in a concentration range of from 10 to 20% by weight, which, upon repeated use, can be quite damaging to the above parts. In order to protect these parts from the acid during the cleaning cycle, inhibitors have been added to the acid cleaning mixtures. However, these inhibitors have generally been of two types, namely, a toxic inhibitor such as diethylthiourea or a nontoxic inhibitor such as gelatin. The use of toxic inhibitors is, of course, quite undesirable, while the use of gelatin alone is also unsatisfactory due to the difficulty of dissolving the gelatin in the cold water and the fact that the gelatin may not protect the metal parts of the well properly, especially the cast iron pump bowl. There is therefore a compelling need for an inhibited acid solution for cleaning potable water wells in which the inhibitor is substantially nontoxic, effective, and readily soluble. Other facilities requiring non-toxic, acid cleaned corrosion inhibitors include water storage tanks, conduits, plumbing, boilers, and the like.

The use of proteins such as gelatin to inhibit the corrosion of metals in acid solution is well known; see for example, Desai, et al., *Werkstoffe Korrosion* 14, 739–42 (1963) which describes the use of gelatin to inhibit the organic acid corrosion of brass. Desai, et al., *J. Inst. Chem. Calcutta* 45, Part IV, 135–7 (1973) describes the use of gelatin as an inhibitor to protect aluminum alloys against acetic acid and chlorosubstituted acetic acids. Talati, et al., *Vidya,* 12(2), 182–192 (1969) discloses the use of gelatin to reduce the corrosion of aluminum and aluminum magnesium alloys when exposed to organic acids. Koshel, et al., *Australas Corros. Eng.,* 18(8), 17–19 (1974) describes the use of casenium purum, dextrin, tannin, gelatin, or carboxymethyl cellulose to prevent weight loss due to corrosion of aluminum in hydrochloric acid. Talati, et al., *Acta. Cienc. Indica.,* 2(3), 219–225 (1976) describes the use of inhibitors such as gelatin, glue, gum tragacanth, agar-agar, acacia, etc., to prevent the corrosion of aluminum alloys in chloroacetic acids.

A number of patents and publications describe the use of gelatin as an inhibitor against the corrosion attack by acids on iron or steel substrates. British Pat. No. 1,052,771 describes the use of gelatin, an arsenate, and a wetting agent with inorganic acids, such as phosphoric acid, to inhibit corrosion on iron or steel. Beloglazov, *Uchenye Zapiski Permsk. Univ.* 13, No. 3, 85–92 (1959) describes the use of inhibitors such as gelatin, casein, glycerol, etc., to protect steel against sulfuric acid. Machu, et al., *Werkstoffe Korrosion,* 13, 745–752 (1962) discloses the inhibition of acid corrosion in sulfuric acid by the addition of gelatin to protect a number of metals including iron metals. Beloglazov, *Uch. Zap. Permsk. Gos. Univ.,* 19, No. 1, 37–41 (1961) discloses the use of agents such as gelatin and casein in acid solutions to prevent hydrogenation and a change in fatigue strength of steel. Cabrera, et al., *Cuba Azucar,* April, June, 13–20 (1977) describe the use of both ammoniated and untreated molasses to protect steel against corrosion during acid cleaning. Cabrera, et al., *Cuba Azucar,* July-September, 20–26 (1976) describes the use of distillery slops for preventing the acid corrosion of steel. The use of hydrolyzates of gelatin to protect certain metals from acid corrosion has also been described. For example, published Japanese Patent Application 74-35,244 describes the use of gelatin or its hydrolyzate to prevent the acid corrosion of copper zinc alloys. U.S. Pat. No. 3,505,184 describes the use of hydrolyzed protein as an inhibitor in a zinc electrodepositing bath. Published Czechoslovakian Patent Application 153,709 discloses the use of protein hydrolyzate to inhibit the corrosion of steel in 39% HCl. U.S. Pat. No. 4,209,418 describes the use of gelatin mixed with benzimidazole compounds (which are toxic), as providing corrosion inhibition for aqueous carboxylic acid metal cleaning solutions. Ammoniated ethylenediamine tetracetic acid (EDTA) and/or ammoniated citric acid are preferred as the carboxylic acids. Minor amounts of ethylquinolinium iodide and/or 2-thio-4,6-dimethyl pyrimidine hydrochloride may be present, although no other ingredients are disclosed. Both of these minor additives, or their analogs, are listed as toxic substances in the Chemical Abstracts Service Registry, the iodide having No. 634-35-5.

DESCRIPTION OF THE INVENTION

Other than in the operating examples, or where otherwise indicated, all numbers expressing quantities of ingredients, reaction conditions, or defining ingredient parameters used herein are to be understood as modified in all instances by the term "about". Unless otherwise indicated, all percentages are percent by weight.

This invention relates to acid cleaning/pickling compositions for metal surfaces containing a novel mixture of ingredients which inhibit corrosion by the acid in the cleaner, corrosion inhibitor additive concentrates for such acid cleaners, and methods for using the foregoing. The acid cleaner compositions of this invention are used to remove water insoluble, acid soluble, deposits from metal surfaces that are in contact with, or may be in contact with, potable water or other potable liquids. Such surfaces include water well casings, liquid storage tanks, water heaters, conduits and the like. For this reason, it is critical that the cleaner ingredients are nontoxic and safe for such use. To realize this, the ingredients are preferably on the GRAS (U.S.F.D.A. Generally Recognized As Safe) list, or even of food grade, where applicable. It also is extremely desirable that the ingredients are biodegradable, where possible.

The acid cleaner compositions according to this invention, in addition to an acid and water, contain corrosion inhibitor ingredients (A) and (B) which may be in the form of a premixed dry or aqueous solution concentrate, or which may be mixed separately with the acid and water.

The novel corrosion inhibiting concentrates (and the acid cleaners themselves) of this invention contain as essential ingredients:

(A) at least one polymer, which may be protein-derived or synthetic; and (B) at least one iodine or iodine-ion affording compound.

Further ingredients when the concentrate is in the form of an aqueous solution include:

(C) at least one anionic, nonionic or amphoteric surfactant, (D) at least one coupling agent (optional), and (E) at least one acidifier Further ingredients when the concentrate is in dry powder form include:

(F) at least one inert diluent (optional); and (G) at least one dedusting agent (optional).

The forgoing ingredients, either individually or in concentrate form, are combined with aqueous acid solutions which have known utility as metal cleaners/picklers. Generally any acid may be used in this invention, provided critically that it is water-soluble, effective for cleaning metal surfaces, non-toxic in the quantity that may remain on the surfaces after water rinsing, and is preferably environmentally safe and/or biodegradable. Examples of known useful acids are: inorganic acids such as hydrochloric (muriatic), sulfuric, boric, nitric, phosphoric, and the like; and organic acids such as formic, citric, acetic, sulfamic, glycolic, benzoic, oxalic, mono-, di-or tri-chloracetic, various $C_{2-22}$ carboxylic acids, and the like. Mixtures of these acids are also useful. The acids in the aqueous solutions are at least minimally present in a cleaner-effective amount, particularly concentrations of 1 to 50% by weight, more preferably in a concentration of 5 to 30% by weight, most preferably 5 to 15% by weight. Hydrochloric acid, sulfamic acid, and/or sodium bisulfate are preferred.

The corrosion inhibited acid cleaner composition of this invention may be prepared by adding the corrosion inhibitor ingredients to the acid aqueous solution in any order and under ambient conditions or slightly elevated temperatures, accompanied by simple mixing.

Because of the difficulties of transporting a large volume of acid solution, it is generally preferable to premix the corrosion inhibitor ingredients to a concentrate and then to prepare the completed corrosion inhibitor acid cleaner at the point of use, or to introduce separately the acid cleaner and corrosion inhibitor concentrate in metered amounts in situ.

(A) Protein-drived polymers useful in this invention include: gelatin, gelatin hydrolysates, casein, casin hydrolysates, starch, agar agar, carrageen, algin, pectin; gums such as locust bean, guar, tragacanth, arabic, karaya, acacia, carob bean, and the like; molasses and extracts thereof; potato, corn, or wheat starch; egg albumin, carboxymethylcellulose, carboxyethylcellulose, tannin, dextrin, sorbitol, and the like. To at least some degree, all protein and/or sugar derived polymers are useful, provided that they are (a) non-toxic (preferably on the GRAS list, most preferably food grade), and (b) preferably biodegradable. Protein hydrolysates such as gelatin hydrolysates and casein hydrolysates or their mixtures are preferred, gelatin hydrolysates being most preferred.

Synthetic polymers useful in this invention are vinyl-based, and must also meet the criteria of nontoxicity and, preferably, must also be environmentally safe and/or degradable. Examples of useful vinyl-based polymers are: polyvinylpyrrolidone (PVP), especially having a viscosity average molecular weight of 5,000 to 50,000, preferably 9,000 to 40,000; polyvinylpolypyrrolidone; vinylpyrrolidone/vinylacetate copolymers with a molecular ratio of 30:70 to 70:30; alkylated vinylpyrrolidone polymers with an average molecular weight of 7,000 to 17,000; vinylpyrrolidone/styrene copolymers; vinylpyrrolidone/quaternized dimethylaminoethylmethacrylate copolymers of varying molecular weight; vinylpyrrolidone/dimethlaminoethylmethacrylate copolymers; poly(methylvinylether/maleic anhydride); poly(octodecylvinyl ether/maleic anhydride); poly(methylvinyl ether); and the like. Of these compounds, vinyl-pyrrolidone polymers are preferred, polyvinylpyrrolidone being most preferred.

Mixtures of any of the above polymers are also useful. In one preferred embodiment, gelatin hydrolysate, casein hydrolysate, or PVP are employed alone or in any combination, mixtures of gelatin hydrolysate and PVP being particularly preferred.

(B) The iodine compounds useful in this invention are those which afford available iodine atoms or ions. These compounds are believed to serve two functions, in that they interact with the polymers and increase their desirable corrosion-inhibitive properties, and in that they also have desirable bactericidal and fungicidal properties. These two functions do not appear to be interrelated. In addition, the iodine compounds must be non-toxic and are preferably degradable or biodegradable, where feasible. Compounds meeting the above criteria which are useful in this invention include iodide salts which dissociate into iodine ions as well as iodophors (iodine complexes with surfactants that act as iodine stabilizers and carriers and which have available iodine). A particularly useful iodophor is nonylphenoxypoly(ethyleneoxy)-ethanol-iodine complex, which provides at least 20% available iodine. Particularly useful iodide salts include potassium iodide, and amine iodides of which ethylene-diamine dihydroiodide is most preferred. Other iodine compounds which may be useful are iodouracil, ethyl iodide, idoacetic acid, iodosalicylic acid, iodobenzene, and the like. All of the above iodine compounds may be used alone or in any combination.

(C) The surfactants useful in this invention are those which are non-toxic, environmentally safe (and biodegradable if feasible), and stable in solutions with a pH of 6 or less. The surfactant is primarily required when an aqueous solution concentrate is prepared, and mainly serves to keep the concentrate ingredients in homogenous phase. It also assists in wetting the metal surface being cleaned, and for this purpose may be included in the dry concentrate as well as in the fully prepared cleaner-inhibitor composition. Where an iodophor is used as the iodine source, it is preferred that the surfactant is one which is itself capable of operating as a surfactant component in an iodophor complex. Iodophor surfactants are generally nonionics, particularly polyoxyethylene-solubilized nonionics. It is known that ethoxylates are capable of solubilizing iodine in aqueous solutions through the formation of addition complexes, and that these complexes maintain the biocidal activity of the iodine while reducing its toxicity to humans [see Kirk-Othmer, *Encyclopedia of Chemical Technology*, 3rd ed., Vol. 22 Pp. 360–362, Wiley and Sons, pub. N.Y., U.S.A.]. Alcohol ethoxylates and alkylphenol ethoxylates are particularly useful. Examples of specific surfactants useful with iodophors include, but are not limited to, polyoxyethylene (20 E.O.) sorbitan monooleate, and nonylphenoxy-poly ethyleneoxy)-ethanol. Since these surfactants also function as a detergent/wetting agent, they typically have a hydrophile-lipophile balance (HLB) number of 13–15. Where the iodine is in the form of a soluble, dissociating salt, the surfactant need only function as a wetting agent and therefore is limited only by the above general criteria. The surfactant may also function as a dedusting agent (see G, below) in a dry concentrate.

(D) The coupling agent is an optional ingredient used as a stabilizer for the aqueous concentrate. Useful coupling agents include propylene glycol and/or sodium xylene sulfonate, propylene glycol being preferred.

(E) The acidifier is only used in the aqueous solution concentrate and serves to maintain the concentrate pH sufficiently low to prevent the iodine compound from precipitating. Any acid meeting the general ingredient criteria and capable of maintaining the aqueous solution concentrate pH at 6 or less, preferably at 1 to 3, can be used, including the cleaner acids. Phosphoric acid, and /or hydrochloric acid is preferred, especially phosphoric acid.

(F) The inert diluent is an optional ingredient only used in the dry concentrate and serves to facilitate mixing of the dry concentrate ingredients and metering of the dry concentrate itself. Any compound which satisfies the general ingredient criteria of this invention and which does not interact with the other ingredients or the metal surfaces to be cleaned may be used. Examples of such diluents are sodium sulfate, sodium acetate, sodium tartrate, potassium or ammonium salts of the above, sugars such as fructose, sucrose, glucose, sorbitol and the like, or any other compound which meets the above criteria, preferably one on the GRAS list or of food grade. Sodium sulfate is a preferred diluent.

(G) The dedusting agent is an optional ingredient only used in the dry concentrate and serves to prevent excess powder dusting. It must meet the general ingredient criteria of this invention including water solubility and may be one or more compounds known to be used for this purpose such as polyoxyethylene (4–30) sorbitan monooleates, monolaurates, monopalmitates, monostearates, tristearates, trioleates, and the like. Polyoxyethylene sorbitan monooleates are preferred, especially those with 18–22 P.O.E. units, most especially one with 20 P.O.E. units (also known as polysorbate 80). Generally, any surfactant other than a cationic may be used for this purpose, including those mentioned above under (C).

The various ingredients in the compositions and concentrates of this invention are used in the following amounts.

I. Acid Cleaner-Corrosion Inhibitor Composition

The acid is present in aqueous solution in at least a minumum cleaner-effective amount. Depending upon the acid, the w/w concentration generally will be a maximum of 50%, 1 to 50% being preferred, 3 to 30% being more preferred, 5 to 20% being most preferred. The total amount of corrosion inhibition ingredients, whether added individually or as a premixed concentrate, is at least a minimum corrosion-inhibitive effective amount, the exact measurement for which will necessarily depend upon the acid being used. Generally, the corrosion inhibitor ingredients will be used in a total amount of 0.5 to 10% w/w where a dry concentrate or dry ingredients are used, preferably 1 to 6, most preferably 1.5 to 5% w/w. Where an aqueous corrosion inhibitor concentrate is used, it will be added to the aqueous acid cleaner in 0.4 to 4% v/v, preferably 0.5 to 2% v/v, most preferably 0.75 to 1.5% v/v.

II. Corrosion Inhibitor Aqueous Solution Concentrate

The above-identified ingredients should be present in the following amounts, all in % w/w.

(A) 1 to 50%, preferably 8 to 20%, most preferably 10 to 15%.

(B) 0.1 to 15%, preferably 1 to 10%, most preferably 2 to 8%.

(C) 1 to 20%, preferably 10 to 18%, most preferably 12 to 16%.

(D) 0 to 12.5%, preferably 5 to 10%, most preferably 6 to 9%.

(E) 0.5 to 5%, preferably 1 to 3%, most preferably 1.5 to 2.5%.

All the above are ingredients mixed with water q.s. to 100%, a preferred amount of water being 50 to 70%. The water should be relatively pure and free of interfering electrolytes, although tap water is acceptable.

III. Corrosion Inhibitor Dry Concentrate

The above identified ingredients should be present in the following amounts, all in % w/w.

(A) 1 to 80%, preferably 5 to 50%, most preferably 20 to 45%.

(B) 0.1 to 15%, preferably 1 to 10%, most preferably 2 to 6%.

(F) 0 to 80%, preferably 20 to 80%, most preferably 50 to 80%.

(G) 0 to 10%, preferably 0.25 to 5%, most preferably 0.5 to 3%.

EXAMPLES

The following illustrate various embodiments of this invention, and are not intended as limiting. In each of Examples 1–5, a simple mixture of the ingredients was made in indeterminate order under ambient conditions (Ex. 1–3) or heated to 32° C. (Ex. 4–5).

TABLE 1

Examples 1–3 (Dry Concentrate)

| Ingredient Category | Ingredient | Amount (parts by weight) Ex. 1 | Ex. 2 | Ex. 3 |
|---|---|---|---|---|
| A | Gelatin hydrolysate ("Peter Cooper Refining Aid" - 92B, a product of Peter Cooper Corporation, Gowanda, N.4.) | 35 | 29 | 15 |
| A | Polyvinylpyrrolidone-visc. ave. mol. wt. 10–40,000 ("PVP-K," a product of GAF Corp., N.4., N.4.) | 10 | 2 | 1 |
| B | Potassium iodide, U.S.P. | 10 | 4 | 2 |
| C | Polyoxyethylene (20) sorbitan monooleate, U.S.P. ("Tween" 80, a product of ICI Americas, Inc., Wilmington, Del.) | 15 | 1 | 0.5 |
| F | Sodium sulfate (anhyd., food grade) | 30 | 64 | 81.5 |
| | | 100 | 100 | 100 |

TABLE 2

| Ingredient Category | Ingredient | Examples 4–5 (Aqueous Concentrate) Amount (parts by weight) Ex. 4 | Ex. 5 |
|---|---|---|---|
| A | Gelatin hydrolysate (as per Ex. 1) | 18 | 12.00 |
| B | Nonylphenoxypoly (ethyleneoxy) ethanol-iodine complex idophor providing at least 20% available iodine ("Biopal" NR-20, a product of GAF Corp., N.Y., N.Y.) | 2 | 1.40 |
| B | Ethylene diamine dihydroiodide | 4 | 3.27 |
| C | Polyoxyethylene (20) sorbitan monoleate (as per Ex. 1) | 4 | 4.00 |
| C | Nonylphenoxypoly (ethyleneoxy) ethanol ("Igepal" CO-660, a product of GAF Corp., N.Y., N.Y.) | 10 | 9.83 |
| D | Propylene glycol | 8 | 7.50 |
| E | Phosphoric acid (75% aq. sol.) | 2 | 2.00 |
| — | Water | q.s. | q.s. |
| | | 100 | 100 |

EXAMPLES 6–53

Complete Compositions and Evaluation

Example 2 from Table 1 and Example 5 from Table 2 were formulated into complete aqueous acid cleaner-corrosion inhibitor compositions in accordance with this invention, using various acids. The complete compositions were then tested on various metal surfaces. Results of these tests are calculated according to an industry standard based upon the pounds of material lost per square foot of surface area per 24 hours (#1 $ft^2$/24 hr.). The industry standards are:

| Amount of Corrosion (#/$ft^2$/24 hr.) | Evaluation | Grade |
|---|---|---|
| .001–.005 | excellent | A |
| .005–.01 | very good | B |
| .01–.02 | good | C |
| .02–.03 | fair | D |
| .03+ | poor | E |
| no protection | no protection | F |

The complete compositions that were prepared and the corrosion inhibition evaluation for each are in the following table. The corrosion inhibitor concentration is based upon the amount of acid (or acid aqueous solution) in v/v unless otherwise stated. The evalution was after 6 hours exposure at 65.5° C.

TABLE 3

| Example | Complete Cleaner Composition Ingredients: Acid | Corrosion Inhibitor: Example | Corrosion Inhibitor: Concentration | Metal Surface that Was Cleaned | Evaluation of Corrosion Inhibition |
|---|---|---|---|---|---|
| 6 | 5% wt HCL | 5 | .001 | 1010 CRS | B |
| 7 | 5% wt HCL | 5 | .001 | 316 SS | B |
| 8 | 5% wt HCL | 5 | .002 | 1010 CRS | B |
| 9 | 5% wt HCL | 5 | .002 | 316 SS | B |
| C-10 | 5% wt HCL | none | — | 1010 CRS | F |
| C-11 | 5% wt HCL | none | — | 316 SS | F |
| 12 | 5% v/v $H_2SO_4$ | 5 | .0005 | 1010 CRS | E |
| 13 | 5% v/v $H_2SO_4$ | 5 | .0005 | 316 SS | A |
| 14 | 5% v/v $H_2SO_4$ | 5 | .001 | 1010 CRS | D |
| 15 | 5% v/v $H_2SO_4$ | 5 | .001 | 316 SS | A |
| C-16 | 5% v/v $H_2SO_4$ | none | — | 1010 CRS | F |
| C-17 | 5% v/v $H_2SO_4$ | none | — | 316 SS | A |
| 18 | 6% wt. oxalic | 5 | .001(w/w) | 1010 CRS | B |
| 19 | 6% wt. oxalic | 5 | .001(w/w) | 316 SS | A |
| 20 | 6% wt. oxalic | 5 | .002(w/w) | 1010 CRS | B |
| 21 | 6% wt. oxalic | 5 | .002(w/w) | 316 SS | A |
| 22 | 5% v/v glacial acetic | 5 | .0005 | 1010 CRS | B |
| 23 | 5% v/v glacial acetic | 5 | .0005 | 316 SS | A |
| 24 | 5% v/v glacial acetic | 5 | .001 | 1010 CRS | A |
| 25 | 5% v/v glacial acetic | 5 | .001 | 316 SS | A |
| C-26 | 5% v/v glacial acetic | none | — | 1010 CRS | D |
| C-27 | 5% v/v glacial acetic | none | — | 316 SS | A |
| 28 | 6.3% v/v $H_3PO_4$ | 5 | .0006 | 1010 CRS | E |
| 29 | 6.3% v/v $H_3PO_4$ | 5 | .0006 | 316 SS | A |
| 30 | 6.3% v/v $H_3PO_4$ | 5 | .0013 | 1010 CRS | E |
| 31 | 6.3% v/v $H_3PO_4$ | 5 | .0013 | 316 SS | A |
| 32 | 6.3% v/v $H_3PO_4$ | 2 | .006(w/w) | 1010 CRS | C |
| 33 | 6.3% v/v $H_3PO_4$ | 2 | .006(w/w) | 316 SS | A |
| C-34 | 6.3% v/v $H_3PO_4$ | none | — | 1010 CRS | F |
| C-35 | 6.3% v/v $H_3PO_4$ | none | — | 316 SS | B |
| 36 | 6% wt tartaric | 5 | .001(w/w) | 1010 CRS | F |
| 37 | 6% wt tartaric | 5 | .001(w/w) | 316 SS | C |
| 38 | 6% wt tartaric | 5 | .002(w/w) | 1010 CRS | F |
| 39 | 6% wt tartaric | 5 | .002(w/w) | 316 SS | B |
| 40 | 6.3% v/v $H_3PO_4$ | 5 | .001 | 1010 CRS | F |
| 41 | 6.3% v/v $H_3PO_4$ | 5 | .0063 | 304 SS | A |
| 42 | 6.3% v/v $H_3PO_4$ | 5 | .006 | 316 SS | A |

TABLE 3-continued

| Complete Cleaner Composition Ingredients | | | | | |
|---|---|---|---|---|---|
| | | Corrosion Inhibitor | | | Evaluation of Corrosion |
| Example | Acid | Example | Concentration | Metal Surface that Was Cleaned | Inhibition |
| 43 | 6.3% v/v $H_3PO_4$ | 5 | .006 | 410 SS | A |
| 44 | 6.3% v/v $H_3PO_4$ | 5 | .006 | Zn | F |
| 45 | 6.3% v/v $H_3PO_4$ | 5 | .006 | Cu | A |
| 46 | 6.3% v/v $H_3PO_4$ | 5 | .006 | Brass | A |
| 47 | 6.3% v/v $H_3PO_4$ | 5 | .006 | Cast Iron | F |
| 48 | 6% wt $NaHSO_4$ | 2 | .0075 | 1010 CRS | B |
| 49 | 6% wt $NaHSO_4$ | 2 | .0075 | 316 SS | A |
| 50 | 6% wt citric | 2 | .0075 | 1010 CRS | C |
| 51 | 6% wt citric | 2 | .0075 | 316 SS | A |
| 52 | 6% wt sulfamic | 2 | .0075 | 1010 CRS | C |
| 54 | 6% wt sulfamic | 2 | .0075 | 316 SS | A |

Notes:
CRS is cold rolled steel
SS is stainless steel
C means a comparison example A further series of cleaner-inhibitor compositions were prepared to show the relative merits of various combinations of gelatin hydrolysate (Gel.), polyvinylpyrrolidone (PVP), and potassium iodide (KI), as well as gelatin hydrolysate alone and PVP alone. The complete compositions contained various w/w percentages of HCl in aqueous solution, the tested corrosion inhibition ingredients were all used in concentrations of 0.005, and all testing was for 30 minutes exposure of the indicated metal test strip.

TABLE 4

| Example | Acid | Corrosion Inhibitor | Metal Surface | Treatment Temperature (°C.) | % Protection |
|---|---|---|---|---|---|
| 54 | 15% w/w HCl | PVP + KI | 1010 CRS | 26.5 | 96.7 |
| 55 | 15% w/w HCl | Gel + KI | 1010 CRS | 26.5 | 95.5 |
| 56 | 15% w/w HCl | Gel + PVP + KI | 1010 CRS | 26.5 | 98.9 |
| C-57 | 15% w/w HCl | Gel + PVP | 1010 CRS | 26.5 | 88.2 |
| C-58 | 15% w/w HCl | Gel | 1010 CRS | 26.5 | 77.1 |
| C-59 | 15% w/w HCl | PVP | 1010 CRS | 26.5 | 70.0 |
| 60 | 6% w/w HCl | PVP + KI | 304 SS | 65.5 | 90.80 |
| 61 | 6% w/w HCl | Gel + KI | 304 SS | 65.5 | 93.0 |
| 62 | 6% w/w HCl | Gel + PVP + KI | 304 SS | 65.5 | 98.68 |
| C-63 | 6% w/w HCl | Gel + PVP | 304 SS | 65.5 | 89.0 |
| C-64 | 6% w/w HCl | Gel | 304 SS | 65.5 | 80.20 |
| C-65 | 6% w/w HCl | PVP | 304 SS | 65.5 | 76.50 |
| 66 | 15% w/w HCl | PVP + KI | Cast Iron | 26.5 | 86.97 |
| 67 | 15% w/w HCl | Gel + KI | Cast Iron | 26.5 | 87.90 |
| 68 | 15% w/w HCl | Gel + PVP + KI | Cast Iron | 26.5 | 94.30 |
| C-69 | 15% w/w HCl | Gel + PVP | Cast Iron | 26.5 | 79.0 |
| C-70 | 15% w/w HCl | Gel | Cast Iron | 26.5 | 70.0 |
| C-71 | 15% w/w HCl | PVP | Cast Iron | 26.5 | 63.0 |

Analysis of the above % Protection figures leads to the following conclusions. It should be noted that the ultimate goal is 100% protection. In all instances, a combination of an iodide (KI) with one or more inventive polymers (Gel, PVP) yields very superior results for any given metal surface. The preferred inventive combination of KI+Gel+PVP in every instance yields the best results, the other inventive combinations being roughly similar. The comparison tests (C-) in all instances yielded inferior results for a given metal surface.

An exemplary formula for a dry corrosion inhibitor concentrate, particularly adapted to be used with an acid cleaner containing primarily sulfamic acid and/or sodium bisulfate aqueous solutions, is as follows (all % in w/w).

(A) Gelatin hydrolysate - 20 to 40%
(A-2) PVP - 1 to 10%
(B) iodide compound - 2 to 6%
(F) sodium sulfate - 20 to 80%; and
(G) polyoxyethylene sorbitan monooleate - 0.05 to 3%

An exemplary formula for an aqueous solution corrosion inhibitor concentrate particularly adapted to be used with an acid cleaner containing primarily hydrochloric acid aqueous solutions, is as follows (all % in v/v).

(A) gelatin hydrolysate - 5 to 20%
(B-1) iodide compound - 1 to 3%
(B-2) iodophor - 1 to 5%
(C-1) polyoxyethylene sorbitan monooleate - 3 to 5%
(C-2) ethoxylated alkyl-phenol - 9 to 11%
(D) propylene glycol - 6 to 9%
(E) phosphoric acid - 1.5 to 2.5%

All mixed with water present in 50 to 70%.

I claim:

1. A corrosion inhibitor dry concentrate, for use in an acid cleaning composition, which does not produce toxic residues and which consists essentially of:

(A) about 1 to about 80% by weight of a gelatin hydrolysate;
(B) about 0.1 to about 15% by weight of at least one iodine or iodine-ion affording composition;
(C) up to about 80% by weight of an inert solid diluent;
(D) up to 10% by weight of a solid dedusting agent; and
(E) from about 1 to about 10% by weight of a polymer containing vinyl pyrrolidone monomeric units and having a viscosity average molecular weight of from about 5,000 to about 50,000.

2. A concentrate according to claim 1, wherein the amount of gelatin hydrolysate is between about 20 and about 45% by weight, the amount of iodine or iodine ion affording composition is between about 2 and about 6% by weight, the amount of inert solid diluent is between about 50 and about 80% by weight, and the amount of dedusting agent is between about 0.5 and about 3% by weight.

3. A concentrate according to claim 2, wherein the inert solid diluent is sodium sulfate.

4. A dry corrosion inhibitor concentrate, for use in an acid cleaning composition, which does not produce toxic residues and which consists essentially of:

(A) about 1 to about 80% by weight of a gelatin hydrolysate;

(B) about 0.1 to about 15% by weight of ethylene diamine dihydroiodide;

(C) about 5 to about 80% by weight of an inert solid diluent; and (D) up to 10% by weight of a solid dedusting agent.

5. A concentrate according to claim 4, wherein the amount of gelatin hydrolysate is between about 20 and about 45% by weight, the amount of ethylene diamine dihydroiodide is between about 2 and about 6% by weight, the amount of inert solid diluent is between about 50 and about 80% by weight, and the amount of dedusting agent is between about 0.5 and about 3% by weight.

6. A concentrate according to claim 5, wherein the inert solid diluent is sodium sulfate.

7. An aqueous corrosion inhibitor solution concentrate, consisting essentially of:

(A) about 1 to about 50% by weight of a gelatin hydrolysate;

(B) about 0.1 to about 15% by weight of at least one iodine or iodide ion affording composition;

(C) about 1 to about 20% by weight of at least one surfactant selected from the group consisting of anionic, nonionic, and amphoteric surfactants;

(D) from about 1 to about 10% by weight of a polymer containing vinyl pyrrolidone monomeric units and having a viscosity average molecular weight of from about 5,000 to about 50,000;

(E) from about 0.5 to about 5% by weight of an acidifier; and (F) water as needed to bring to 100%.

8. A concentrate according to claim 7, wherein the amount of gelatin hydrolysate is between about 10 to about 15% by weight; the amount of iodine or iodine ion affording composition is between about 2 and about 8% by weight; the amount of surfactant is between about 12 to about 16% by weight; and the amount of acidifier is between about 1.5 and 2.5% by weight.

9. An aqueous corrosion inhibitor solution concentrate, consisting essentially of:

(A) about 1 to about 50% by weight of a gelatin hydrolysate;

(B) about 0.1 to about 15% by weight of ethylene diamine dihydroiodide;

(C) about 1 to about 20% by weight of at least one surfactant selected from the group consisting of anionic, nonionic, and amphoteric surfactants;

(D) from about 0.5 to about 5% by weight of an acidifier; and (E) water to bring to 100%.

10. A concentrate according to claim 9, wherein the amount of gelatin hydrolysate is between about 10 to about 15% by weight; the amount of ethylene diamine dihydroiodide is between about 2 and about 8% by weight; the amount of surfactant is between about 12 to about 16% by weight; and the amount of acidifier is between about 1.5 and 2.5% by weight.

11. A corrosion inhibited acid cleaning composition consisting essentially of:

(A) from about 1 to about 50% by weight of an acid;

(B) a corrosion inhibiting effective amount of a concentrate consisting essentially of:

(i) about 1 to about 80% by weight of a gelatin hydrolysate;

(ii) about 0.1 to about 15% by weight of at least one iodine or iodine-ion affording composition;

(iii) up to about 80% by weight of an inert solid diluent;

(iv) up to 10% by weight of a solid dedusting agent; and (v) from about 1 to about 10% by weight of a polymer containing vinyl pyrrolidone monomeric units and having a viscosity average molecular weight of from about 5,000 to about 50,000; and:

(C) water, if needed, to bring to 100%.

12. A corrosion inhibited acid cleaning composition consisting essentially of:

(A) from about 1 to about 50% by weight of an acid;

(B) a corrosion inhibiting effective amount of a concentrate consisting essentially of:

(i) about 1 to about 80% by weight of a gelatin hydrolysate;

(ii) about 0.1 to about 15% by weight of ethylene diamine dihydroiodide;

(iii) about 5 to about 80% by weight of an inert solid diluent; and (iv) up to 10% by weight of a solid dedusting agent; and (C) water, if needed, to bring to 100%.

13. A corrosion inhibited acid cleaning composition consisting essentially of:

(A) from about 1 to about 50% by weight of an acid;

(B) a corrosion inhibiting effective amount of a concentrate consisting essentially of:

(i) about 1 to about 50% by weight of a gelatin hydrolysate;

(ii) about 0.1 to about 15% by weight of at least one iodine or iodide ion affording composition;

(iii) about 1 to about 20% by weight of at least one surfactant selected from the group consisting of anionic, nonionic, and amphoteric surfactants;

(iv) from about 1 to about 10% by weight of a polymer containing vinyl pyrrolidone monomeric units and having a viscosity average molecular weight of from about 5,000 to about 50,000;

(v) from about 0.5 to about 5% by weight of an acidifier; and (vi) water to bring to 100%; and (C) water, if needed, to bring to 100%.

14. A corrosion inhibited acid cleaning composition consisting essentially of:

(A) from about 1 to about 50% by weight of an acid;

(B) a corrosion inhibiting effective amount of a concentrate consisting essentially of;

(i) about 1 to about 50% by weight of a gelatin hydrolysate;

(ii) about 0.1 to about 15% by weight of ethylene diamine dihydroiodide;

(iii) about 1 to about 20% by weight of at least one surfactant selected from the group consisting of anionic, nonionic, and amphoteric surfactants;

(iv) about 0.5 to about 5% by weight of an acidifier; and (v) water to bring to 100%; and (C) water, if needed, to bring to 100%.

* * * * *